US010018082B2

(12) United States Patent
Yano et al.

(10) Patent No.: US 10,018,082 B2
(45) Date of Patent: Jul. 10, 2018

(54) VARIABLE VALVE MECHANISM

(71) Applicant: TOYOTA JIDOSHA KABUSHIKI KAISHA, Toyota-shi (JP)

(72) Inventors: Toshiyuki Yano, Nagakute (JP); Yu Yokoyama, Okazaki (JP); Toru Sakuma, Nisshin (JP); Yuta Nishimura, Toyota (JP); Atsuhisa Tamano, Anjo (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 85 days.

(21) Appl. No.: 15/333,787

(22) Filed: Oct. 25, 2016

(65) Prior Publication Data

US 2017/0122143 A1 May 4, 2017

(30) Foreign Application Priority Data

Oct. 29, 2015 (JP) ..... 2015-212800

(51) Int. Cl.

| | |
|---|---|
| ***F01L 1/46*** | (2006.01) |
| ***F01L 1/344*** | (2006.01) |
| ***F01L 1/047*** | (2006.01) |
| ***F01L 13/00*** | (2006.01) |

(52) U.S. Cl.

CPC ..... *F01L 1/34413* (2013.01); *F01L 1/047* (2013.01); *F01L 13/0036* (2013.01); *F01L 1/344* (2013.01); *F01L 1/46* (2013.01); *F01L 2001/0473* (2013.01); *F01L 2013/0052* (2013.01)

(58) Field of Classification Search

CPC ..... F01L 2001/0473; F01L 1/267; F01L 1/46; F01L 2013/0052

USPC ..... 123/90.16, 90.18

See application file for complete search history.

(56) References Cited

U.S. PATENT DOCUMENTS

| | | | | |
|---|---|---|---|---|
| 2010/0126447 | A1* | 5/2010 | Talan | F01L 13/0036 123/90.17 |
| 2010/0269769 | A1 | 10/2010 | Schoeneberg et al. | |
| 2015/0184554 | A1* | 7/2015 | Nendel | F01L 13/0036 123/90.17 |
| 2016/0017763 | A1* | 1/2016 | Lengfeld | F01L 13/0036 123/90.6 |

FOREIGN PATENT DOCUMENTS

| | | |
|---|---|---|
| DE | 102008024911 A1 | 11/2009 |
| JP | 2010-520395 | 6/2010 |
| WO | WO 2010/089068 A | 8/2010 |

* cited by examiner

*Primary Examiner* — Jorge Leon, Jr.

(74) *Attorney, Agent, or Firm* — Oblon, McClelland, Maier & Neustadt, L.L.P.

(57) ABSTRACT

A variable valve mechanism includes a cam shaft, a cam unit, a guide portion and a shift pin. The guide portion includes a guide plate provided on an outer periphery of a cam unit, a first stopper and a second stopper. The guide plate is pivotally supported at a first part such that a second part of the guide plate is inclined toward a first side or a second side. The first and second stoppers abut with the second part from the first side and the second side, respectively, so as to hold the second part at a first position and a second position, respectively. The first part includes two arms projecting toward the first side and the second side. The two arms are configured to swing the guide plate.

4 Claims, 9 Drawing Sheets

VARIABLE VALVE MECHANISM

INCORPORATION BY REFERENCE

The disclosure of Japanese Patent Application No. 2015-212800 filed on Oct. 29, 2015 including the specification, drawings and abstract is incorporated herein by reference in its entirety.

BACKGROUND

1. Technical Field

The present disclosure relates to a variable valve mechanism used in a valve system of an engine, and the like, for example.

2. Description of Related Art

As a variable valve mechanism that can change a lift characteristic of an intake valve or an exhaust valve of an engine, a Variable Valve Timing (VVT) mechanism that can continuously change a valve timing is used. Published Japanese Translation of PCT application No. 2010-520395 (JP-A-2010-520395) describes a cam-switch-type mechanism configured such that a cam carrier (a cam unit) including a plurality of cams is provided around a cam shaft, and any of the cams is selected by sliding the cam carrier in an axial direction (a cam axial direction) of the cam shaft.

In the above variable valve mechanism, a spiral guide groove is provided on an outer periphery of the cam carrier, and an engagement element (hereinafter referred to as a shift pin) of a servo-mechanism is engaged with the spiral guide groove of the cam carrier. With such a configuration, when the cam carrier rotates integrally with the cam shaft, the shift pin relatively moves along the spiral guide groove. Hereby, the cam carrier practically slides in the cam axial direction so that the engagement between the guide groove and shift pin is maintained.

As illustrated in FIG. 8, the spiral guide groove G is formed as a Y-shaped groove as a whole such that an S-shaped groove g1 and a reverse S-shaped groove g2 formed on an outer periphery of a cam carrier C so as to extend in a circumferential direction are joined to each other. When the cam carrier C is moved toward a left side in FIG. 8, the shift pin P is inserted into the S-shaped groove g1, so that the shift pin P is relatively moved along the groove g1 toward a right side in the figure. Further, as illustrated in a developed view of FIG. 9, the Y-shaped guide groove G requires a width of at least 2×S+D. Here, S indicates a slide amount in the cam axial direction to switch cams by the S-shaped groove g1 and the reverse S-shaped groove g2 and D indicates a diameter of the shift pin P.

SUMMARY

In the meantime, compactification is requested to the valve system of the engine. In the above cam carrier C, a width of the Y-shaped guide groove G easily becomes large, which becomes an obstacle to the compactification.

Further, in the above technique, in order to move the cam carrier C to the left side, a shift pin P to be engaged with the S-shaped groove g1 is required, and in order to move the cam carrier C to the right side, another shift pin P to be engaged with the reverse S-shaped groove g2 is required. On this account, two servo-mechanisms are required or a structure to operate two shift pins P with one servo-mechanism becomes complicated, which causes an increase in cost.

The present disclosure provides a technique to achieve compactification of a cam unit while restraining an increase in cost in a variable valve mechanism for an engine or the like.

An example aspect of the disclosure provides a variable valve mechanism comprising a cam shaft, a cam unit, a guide portion and a shift pin. The cam unit has a cylindrical shape and provided around the cam shaft. The cam unit includes a plurality of cams. The cam unit is configured to be slid in a cam axial direction along with a rotation of the cam shaft such that one of the plurality of cams is selected. The cam axial direction is an axial direction of the cam shaft. The guide portion is provided on an outer periphery of the cam unit. The shift pin is configured to externally engage with the guide portion. The guide portion includes a guide plate, a first stopper and a second stopper. The guide plate is provided on the outer periphery of the cam unit such that the guide plate extends in a circumferential direction of the cam unit. The guide plate includes a first part on a base side of the guide plate, and a second part on a tip side of the guide plate, the second part extends from the first part in a rotation direction of the cam shaft. The guide plate is pivotally supported at the first part. The guide plate is configured to swing such that the second part is inclined to one of a first side and a second side in the cam axial direction. The first stopper is configured to abut with the second part from the first side such that the first stopper holds the guide plate at a first position inclined toward the first side at a predetermined angle. The second stopper is configured to abut with the second part from the second side such that the second stopper holds the guide plate at a second position inclined toward the second side at a predetermined angle. The first part includes two arms, the two arms projecting toward the first side and the second side, respectively. The two arms are configured to swing the guide plate by engagement with the shift pin.

In the variable valve mechanism configured as described above, first, in a case where the guide plate is placed at the first position on the outer periphery of the cam unit, when the shift pin is externally engaged with the guide plate, the shift pin slides on a second side face of the guide plate from a tip side to a base side along with a rotation of the cam unit, so as to slide the cam unit toward the first side via the guide plate. Then, the shift pin engages with the arm projecting toward the second side from the base-side part of the guide plate, so as to swing the guide plate toward the second position.

Further, at the time when the guide plate is placed at the second position, the shift pin slides on a first side face thereof from the tip side to the base side, so as to slide the cam unit toward the second side. After that, the shift pin engages with the arm projecting toward the first side from the base-side part of the guide plate, so as to swing the guide plate toward the first position.

That is, a direction where the guide plate is inclined is changed between the first and second positions, so as to slide the cam unit in a reciprocating manner toward the first side and the second side in the cam axial direction by engagement between the guide plate and the shift pin. At this time, the shift pin relatively reciprocates toward the first side and the second side in the cam axial direction on the outer periphery of the cam unit.

From this point, when a slide amount of the cam unit to switch cams is indicated by S and a diameter of the shift pin is indicated by D, a length, in the cam axial direction, necessary for a relative movement of the shift pin on the outer periphery of the cam unit is generally S+D. Therefore, in comparison with the related art that requires a length of at least 2×S+D, compactification of the cam unit is achieved.

Besides, a direction where the guide plate is inclined is different between a time when the cam unit is moved toward the first side in the cam axial direction and a time when the cam unit is moved toward the second side, which is a reverse side to the above. Accordingly, only one shift pin to be engaged with the guide plate is required. From this point, it is possible to achieve reduction in cost in comparison with the related art that requires two shift pins, and even if the guide plate, a position of which is changed, is provided, it is possible to restrain an increase in cost.

In the variable valve mechanism, the first stopper may be configured to hold the guide plate placed at the first position in a state where the guide plate is inclined at an acute angle toward the first side. The second stopper may be configured to hold the guide plate placed at the second position in a state where the guide plate is inclined at an acute angle toward the second position. As an inclination angle is smaller, a frictional force caused when the shift pin slides along the side face of the guide plate can be reduced. In view of this, it is preferable that the inclination angle be 45° or less, for example.

In the variable valve mechanism, the second part may include a first side face on the first side and a second side face on the second side. The first side face may be provided with a first abutting surface configured to make surface contact with the first stopper, and the second side face may provided with a second abutting surface configured to make surface contact with the second stopper. With such a configuration, when either of the abutting surfaces makes surface contact with a corresponding one of the first and second stoppers, it is possible to stably hold the guide plate at a corresponding one of the first and second positions.

The variable valve mechanism may further include a ball member and a biasing member. The guide plate may include a projection. The ball member may be configured to abut with the projection. The biasing member may be configured to press the ball member toward the projection. The projection may include a first inclined surface and a second inclined surface. The ball member may be configured to press the first inclined surface so as to bias the guide plate toward the first position, when the guide plate is biased closer to the first position relative to an intermediate position between the first position and the second position. The ball member may be configured to press the second inclined surface so as to bias the guide plate toward the second position, when the guide plate is biased closer to the second position relative to the intermediate position.

According to the variable valve mechanism according to the present disclosure, the guide plate with which the shift pin engages is switched between the first and second positions so as to slide the cam unit in a reciprocating manner toward the first side and the second side in the cam axial direction. Accordingly, a large width (length in the cam axial direction) is not required like the Y-shaped guide groove in the related art, thereby achieving the compactification of the cam unit. Besides, it is possible to slide the cam unit by the same shift pin toward both the first side and the second side, thereby making it possible to restrain an increase in cost.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

The following will describe an embodiment in which a variable valve mechanism of the present disclosure is applied to a valve system of an engine, with reference to the drawings. An engine 1 of the present embodiment is an inline four-cylinder gasoline engine 1, as an example. As schematically illustrated in FIG. 1, four cylinders, i.e., first to fourth cylinders 3 (#1 to #4) are arranged side by side in a longitudinal direction of a cylinder block (not shown), i.e., in a front-rear direction (a right-left direction indicated by an arrow in FIG. 1) of the engine 1.

Figure 1:
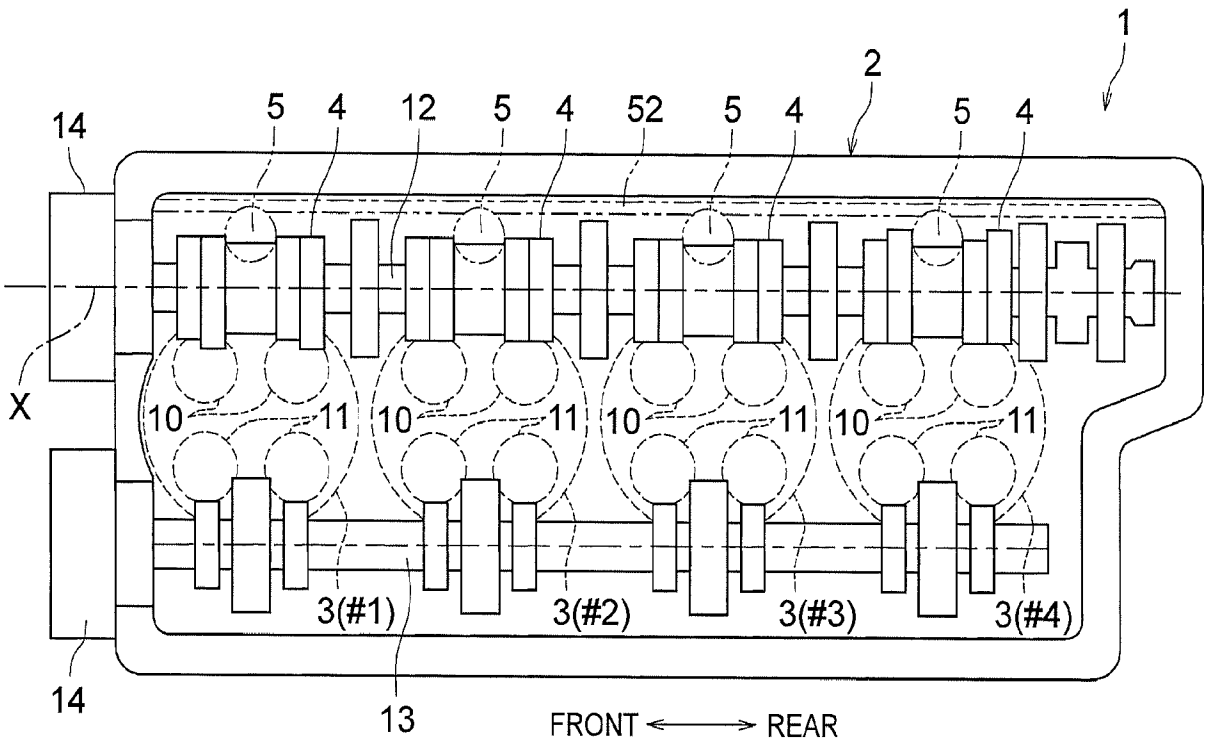
FIG. 1 is a schematic configuration diagram of a valve system of an engine equipped with a variable valve mechanism according to an embodiment.

When viewed from above in FIG. 1, a cam housing 2 is disposed on an upper part (a cylinder head) of the engine 1, so as to accommodate valve systems for intake valves 10 and exhaust valves 11. That is, as indicated by a broken line in FIG. 1, the four cylinders 3 arranged in line in the front-rear direction of the engine 1 are each provided with two intake valves 10 and two exhaust valves 11, which are driven by an intake cam shaft 12 and an exhaust cam shaft 13, respectively.

Respective front ends (left ends in FIG. 1) of the intake cam shaft 12 and the exhaust cam shaft 13 are provided with respective Variable Valve Timing (VVT) mechanisms 14 that continuously change valve timings. The intake cam shaft 12 includes a cam switch mechanism (an example of a variable valve mechanism) that changes a lift characteristic of the intake valve 10 by switching cams 41, 42 that drive the intake valve 10 (see FIG. 2). The cam switch mechanism is provided for each cylinder 3.

Figure 2:
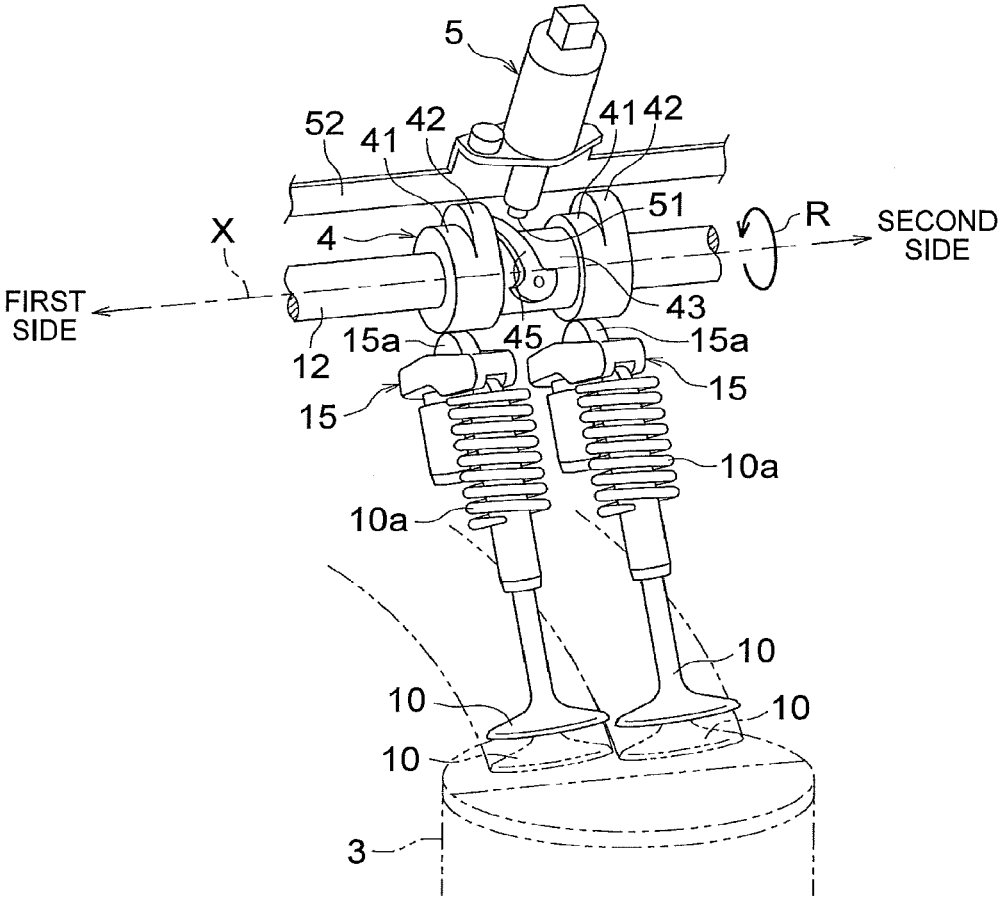
FIG. 2 is a perspective view illustrating an intake-side valve system in a given cylinder in an enlarged manner, according to the embodiment.

As an example, as illustrated in FIG. 2 that illustrates the second cylinder 3 (#2) in an enlarged manner, two cams 41, 42 having different profiles are provided for each of two intake valves 10 in each cylinder 3 such that either of the two cams 41, 42 drives its corresponding intake valve 10 via a rocker arm 15. The two cams 41, 42 are provided adjacently in a direction (a cam axial direction) of an axis X of the intake cam shaft 12. In FIG. 2, the cam 41 on a left side (a first side) is a low lift cam 41 having a relatively small cam lobe, and the cam 42 on a right side (a second side) is a high lift cam 42 having a relatively large cam lobe.

Base circles of the low lift cam 41 and the high lift cam 42 have the same diameter, and are formed as arc surfaces continuous with each other. FIG. 2 illustrates a state where the low lift cam 41 is selected, and a roller 15*a* of the rocker arm 15 abuts with a base circle zone of the low lift cam 41, so that the roller 15*a* is pressed against the low lift cam 41 by a reaction force of a valve spring 10*a* of the intake valve 10. In a state where the roller 15*a* of the rocker arm 15 abuts with the base circle zone as such, the intake valve 10 does not lift.

When the intake cam shaft 12 rotates in a direction indicated by an arrow R, the cam lobe of the low lift cam 41 presses the roller 15*a* so as to push down the rocker arm 15, although not illustrated herein. This causes the rocker arm 15 to drive the intake valve 10 according to the profile of the cam lobe, so that the intake valve 10 lifts, as indicated by a virtual line in FIG. 2, against the reaction force of the valve spring 10*a*.

Next will be described a configuration of the cam switch mechanism. In the present embodiment, a cam to lift the intake valve 10 via the rocker arm 15 is switched between the low lift cam 41 and the high lift cam 42, as described above. That is, as illustrated in FIGS. 2, 3, 4A, 4B, the two cams 41, 42 are formed integrally in a ring shape and fitted to an end portion of a cylindrical sleeve 43 in its axis-X direction, thereby constituting a cam unit 4. The cam unit 4 (or the sleeve 43) is slidably provided around the intake cam shaft 12.

Figure 3:
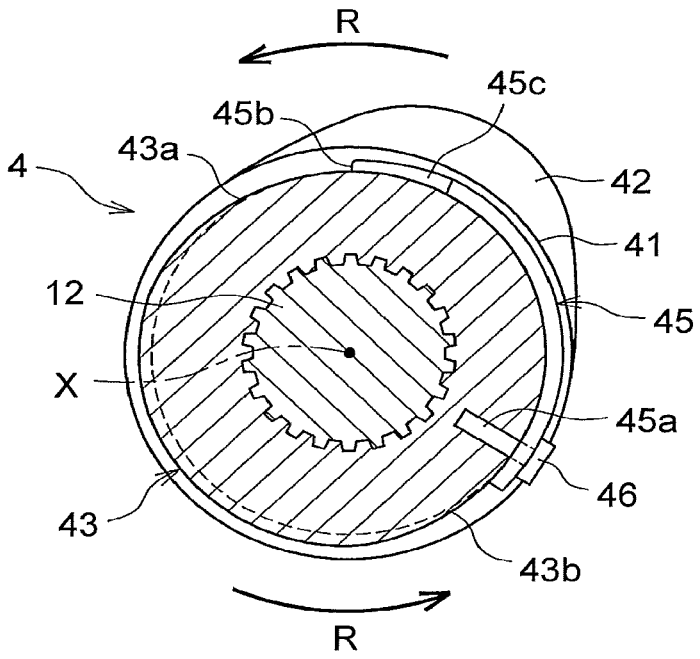
FIG. 3 is a cross-sectional view of a cam unit provided around an intake cam shaft, according to the embodiment.

As illustrated on a cross section perpendicular to the axis X in FIG. 3, internal teeth of a spline is formed on an inner periphery of the sleeve 43 of the cam unit 4 and mesh with external teeth of a spline formed on an outer periphery of the intake cam shaft 12. That is, the cam unit 4 (the sleeve 43) is spline engaged to the intake cam shaft 12, and the cam unit 4 rotates integrally with the intake cam shaft 12 and slides thereon in the axis-X direction. Due to the sliding, the cam unit 4 is switched between a low lift position at which the low lift cam 41 is selected and a high lift position at which the high lift cam 42 is selected.

In order to slide the cam unit 4 as such, a guide plate 45 for guiding a shift pin 51 is provided on an outer periphery (an outer periphery of the cam unit 4) of the sleeve 43 in an intermediate part in the axis-X direction as described below. As illustrated in FIG. 3, the guide plate 45 extends in a circumferential direction while curving generally along with an outer peripheral surface of the cam unit 4. Further, as will be described later, the guide plate 45 swings so as to be inclined to the first side or the second side in the axis-X direction.

That is, as illustrated in FIG. 2, an actuator 5 configured to drive the shift pin 51 in a reciprocating manner is provided for each cylinder 3 so as to be disposed above the intake cam shaft 12. The actuator 5 is supported by the cam housing 2 via a stay 52 extending in the axis-X direction, for example. The actuator 5 drives the shift pin 51 by an electromagnetic solenoid, and in an ON state, the shift pin 51 moves forward so as to be engaged with the guide plate 45.

When the shift pin 51 moves forward so as to be engaged with the guide plate 45, the shift pin 51 relatively moves on the outer peripheral surface of the cam unit 4 in a circumferential direction along with a rotation of the intake cam shaft 12, and also moves toward the first side in the axis-X direction along the guide plate 45, namely, moves diagonally. This will be described below with reference to FIGS. 5, 6. At this time, the cam unit 4 practically slides relative to the shift pin 51 in the axis-X direction while rotating relative to the shift pin 51.

For example, as illustrated in FIG. 2, in a case where a tip side (an upper side in the figure) of the guide plate 45 is inclined toward the first side (the left side in the figure) in the axis-X direction, when the actuator 5 is turned on, the shift pin 51 moving forward hereby is engaged with a side face of the guide plate 45 on the second side (the right side in the figure) in the axis-X direction. Along with a rotation of the intake cam shaft 12 as indicated by an arrow R in FIG. 2, the shift pin 51 presses the cam unit 4 toward the first side (the left side in the figure) in the axis-X direction so as to slide the cam unit 4.

Further, in order to engage the shift pin 51 with the guide plate 45 smoothly as such, an outside diameter of an outer peripheral surface of the sleeve 43 of the cam unit 4 gradually changes in vicinity of the guide plate 45, as illustrated in FIG. 3. That is, an outer shape of the sleeve 43 is basically a perfect circle shape as indicated by a virtual line in FIG. 3, and the outside diameter is gradually increased toward a side separated in a circumferential direction from a base end 45*a* (a base-side part placed on a rear side in a direction R where the intake cam shaft 12 rotates) of the guide plate 45 and a tip end 45*b* of the guide plate 45.

Such a part having an outside diameter increased toward the side separated in the circumferential direction from the tip end 45*b* of the guide plate 45 is an introduction zone 43*a* at the time when the shift pin 51 is engaged with the guide plate 45. When the shift pin 51 is moved forward in the introduction zone 43*a* such that its tip end is pressed against the outer peripheral surface of the sleeve 43, the shift pin 51 gradually moves forward along with a rotation of the intake cam shaft 12, so that the shift pin 51 smoothly engages with the guide plate 45.

In the meantime, such a part having an outside diameter increased toward the side separated in the circumferential direction from the base end 45*a* of the guide plate 45 is a lead-out zone 43*b* where the shift pin 51 is moved backward from the guide plate 45. In the lead-out zone 43*b*, along with a rotation of the intake cam shaft 12, the tip end of the shift pin 51 is gradually pushed back by the outer peripheral surface of the sleeve 43. When the actuator 5 is turned off, the shift pin 51 is moved backward to a position where the shift pin 51 does not engage with the guide plate 45.

Figure 5:
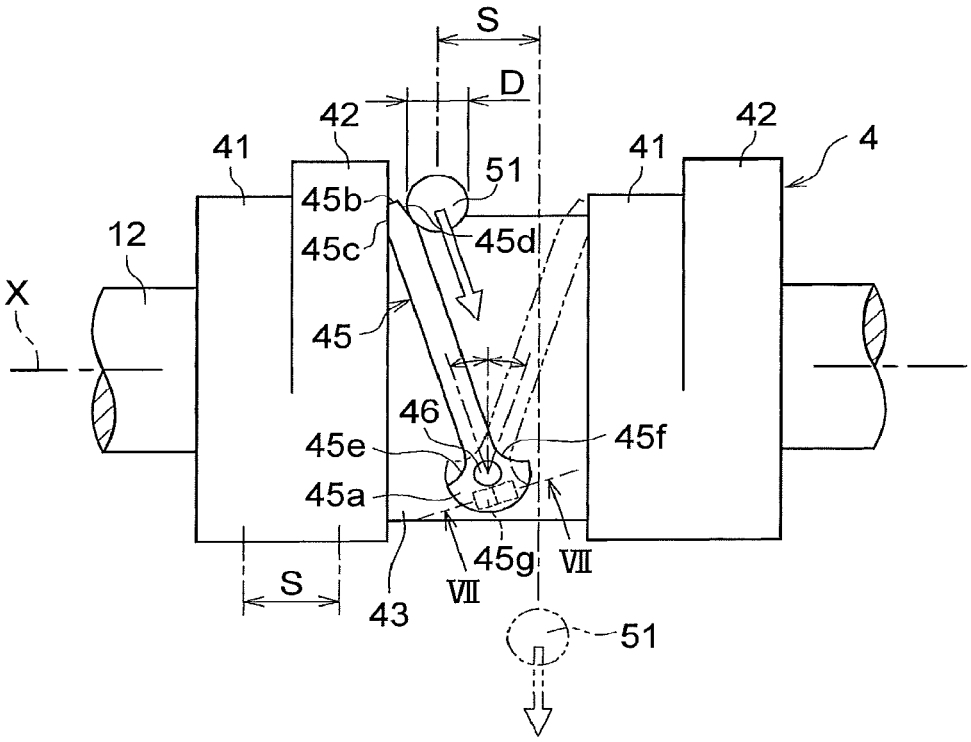
FIG. 5 is a view schematically illustrating an essential part of a cam switch mechanism, and a continuous line indicates a case where a guide plate is placed at a first position and a virtual line indicates a case where the guide plate is placed at a second position, according to the embodiment.

The following describes the guide plate 45, more specifically. As schematically illustrated in FIG. 5, the base end 45*a* of the guide plate 45 is pivotally supported by a spindle 46 fitted in the sleeve 43 of the cam unit 4. Then, the guide plate 45 swings around the base end 45*a* such that a tip-side part (a tip-side part placed on a front side in a direction where the intake cam shaft 12 rotates) of the guide plate 45, extending from the base end 45*a* in the direction where the intake cam shaft 12 rotates, is inclined to the first side or the second side (the left side or the right side in FIG. 5) in the axis-X direction.

Hereinafter, in a case where the description is made with reference to FIG. 5, the first side and the second side in the axis-X direction are just referred to as the left side and the right side, respectively, for convenience. An abutting surface 45*c* is formed on the left side of the tip end 45*b* of the guide plate 45 swinging as described above, so that the abutting surface 45*c* makes surface contact with a side face of the high lift cam 42 placed on the left side thereof. Hereby, the guide plate 45 is stably held at a first position inclined leftward at a predetermined angle θ (an acute angle, preferably 25° to 45°, for example) based on a direction (the up-down direction in FIG. 5) that is perpendicular to the axis X on the outer periphery of the cam unit 4.

Similarly, an abutting surface 45*d* is formed on the right side of the tip end 45*b* of the guide plate 45 so as to make surface contact with a side face of the low lift cam 41 placed on the right side thereof. Hereby, the guide plate 45 is also stably held at a second position inclined rightward at the predetermined angle θ. In other words, in the present embodiment, two cams 41, 42 are used as first and second stoppers that abut with the abutting surfaces 45*c*, 45*d* on the tip side of the guide plate 45 so as to hold the guide plate 45.

With such a configuration, as indicated by a continuous line in FIG. 5, in a case where the guide plate 45 is placed at the first position, when the shift pin 51 is engaged with a right side face of the guide plate 45, the shift pin 51 relatively moves in the circumferential direction on the outer peripheral surface of the cam unit 4 along with a rotation of the intake cam shaft 12 and the cam unit 4, and also moves toward the first side in the axis-X direction along the guide plate 45, namely, moves diagonally as indicated by an arrow in the figure.

At this time, as will be described later with reference to FIGS. 6A to 6C, the shift pin 51 presses the guide plate 45 from the right side along with the rotation of the cam unit 4. Hereby, practically, the shift pin 51 slides the cam unit 4 leftward through this. In order to hereby switch from the low lift cam 41 to the high lift cam 42 by sliding the cam unit 4 as such, the cam unit 4 is slid only by a distance S (a dimension in the axis-X direction) between these two cams 41, 42.

That is, as illustrated in FIG. 5, a relative moving amount of the shift pin 51 to the right side (the second side in the axis-X direction) on the outer peripheral surface of the cam unit 4 is the same as a distance S between the two cams 41, 42. Therefore, as illustrated in FIG. 5, when a diameter of the shift pin 51 is D, a dimension (a width) in the axis-X direction should be set to about S+D in the axis-X direction on the outer peripheral surface of the cam unit 4, in order to slide the cam unit 4 to be switched to the high lift position from the low lift position as described above.

In the present embodiment, a locking mechanism 6 is provided so as to hold a position (the low lift position, the high lift position) of the cam unit 4 at the time when the low lift cam 41 is switched to the high lift cam 42 or vice versa. That is, two annular grooves 43*c*, 43*d* are formed side by side near a center in the axis-X direction (the right-left direction in FIGS. 4A, 4B) on an inner peripheral surface of the sleeve 43 of the cam unit 4 as illustrated in FIGS. 4A, 4B, and an annular projection 43*e* formed to remain therebetween is placed generally in a center in the axis-X direction.

A locking member 61 is retractably disposed on the outer periphery of the intake cam shaft 12 so as to be engaged with a corresponding one of the annular grooves 43*c*, 43*d* at the time when the cam unit 4 is placed at the low lift position or the high lift position. For example, the locking member 61 is a locking ball. The locking member 61 is accommodated in a hole 12*a* having a circular sectional shape and opened on an outer peripheral surface of the intake cam shaft 12, and is pressed outwardly by a coil spring 62. That is, the locking member 61 is pressed toward the inner peripheral surface of the sleeve 43 opposed thereto radially outwardly from the hole 12*a* of the intake cam shaft 12.

Figure 4A:
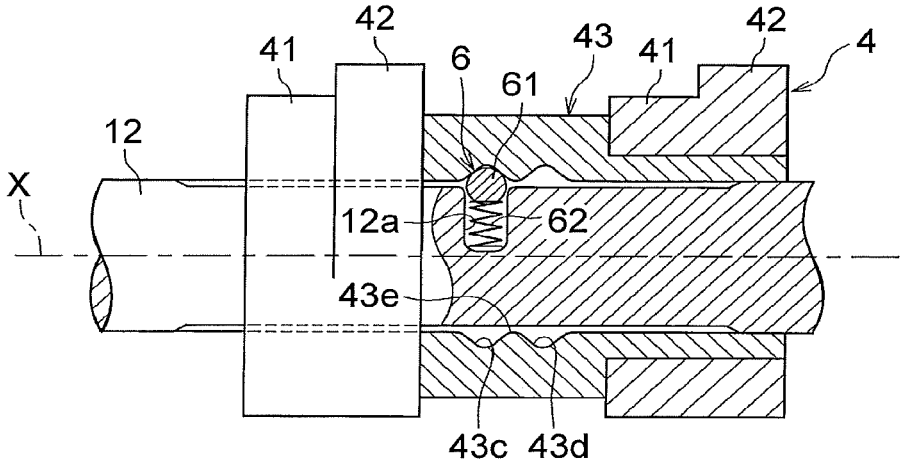
FIG. 4A is a drawing of a longitudinal section of a lock mechanism, according to the embodiment.
Figure 4B:
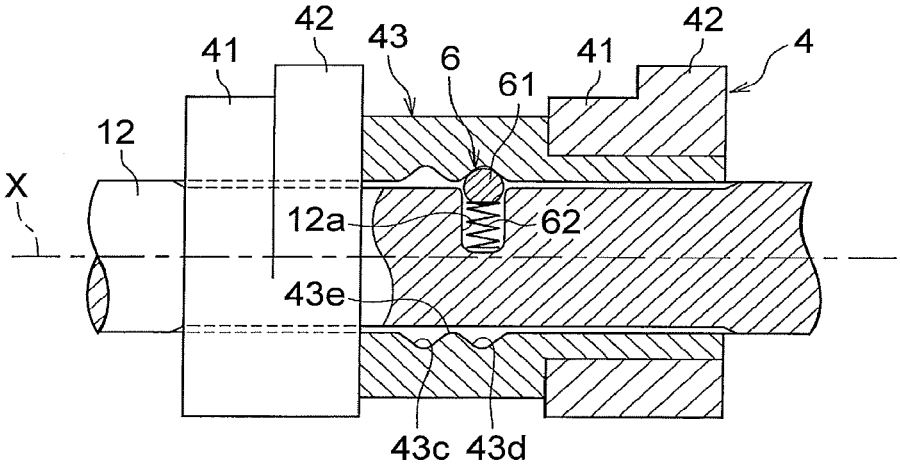
FIG. 4B is a drawing of the longitudinal section of the lock mechanism, according to the embodiment.

Hereby, when the cam unit 4 is placed at the low lift position on the second side in the axis-X direction (the right side in FIG. 4A) as illustrated in FIG. 4A, the locking member 61 is engaged with the annular groove 43*c* so as to hold the position of the cam unit 4. Further, when the cam unit 4 is placed at the high lift position on the first side in the axis-X direction (the left side in FIG. 4B) as illustrated in FIG. 4B, the locking member 61 is engaged with the annular groove 43*d* so as to hold the position of the cam unit 4.

Again referring to FIG. 5, the base end 45*a* of the guide plate 45 is provided with arms 45*e*, 45*f* so as to engage with the shift pin 51 and swing the guide plate 45 after the cam unit 4 is slid as described above. These arms 45*e*, 45*f* project leftward and rightward from the base end 45*a* of the guide plate 45, respectively, and have gradually recessed curved surfaces continuous with respective side faces of the guide plate 45. A curvature of the recessed curved surfaces is generally the same as a curvature of the outer peripheral surface of the shift pin 51.

After the shift pin 51 engages with the right side face of the guide plate 45 placed at the first position and slides the cam unit 4 leftward as described above, the shift pin 51 engages with the right arm 45*f* of the base end 45*a* of the guide plate 45 so as to press the right arm 45*f* rearward (a lower side in FIG. 5) in a direction where the cam unit 4 rotates, as will be described later with reference to FIGS. 6A to 6C. Hereby, the guide plate 45 swings around the spindle 46 of the base end 45*a* so as to be switched to the second position.

Note that, when the guide plate 45 is placed at the second position as indicated by a virtual line in FIG. 5, the shift pin 51 can be engaged with the left side face of the guide plate 45 so as to slide the cam unit 4 rightward, although not illustrated herein. After that, the shift pin 51 engages with the left arm 45*e* of the base end 45*a* of the guide plate 45, so as to press the left arm 45*e* downward in FIG. 5. Hereby, the guide plate 45 swings so as to be switched to the first position.

The guide plate 45 of the present embodiment is also provided with a mechanism for biasing the guide plate 45 to the first and second positions to be switched as described above. That is, as illustrated on an upper side in FIG. 7 that illustrates a section taken along a line VII-VII in FIG. 5, the base end 45*a* of the guide plate 45 is provided with a projection 45*g* having a triangular section and projecting toward the outer peripheral surface of the sleeve 43 of the cam unit 4 (downward in FIG. 7).

A tip of the projection 45*g* is placed on a center line of the guide plate 45 in its longitudinal direction, and has first and second inclined surfaces 45*g*1, 45*g*2 on the first side (the left side in FIG. 7) and the second side (the right side of FIG. 7) in a width direction of the guide plate 45, respectively. When the guide plate 45 is switched between the first and second positions, a ball member 47 retractably provided on the outer periphery of the sleeve 43 is pressed against the first inclined surface 45*g*1 or the second inclined surface 45*g*2 of the projection 45*g*.

More specifically, the ball member 47 is accommodated in a hole 43*f* having a circular sectional shape and opened on the outer peripheral surface of the sleeve 43 of the cam unit 4, and is pressed outwardly by a coil spring 48 (a spring member). As illustrated on an upper side in FIG. 7, when the guide plate 45 is biased closer to the first position (closer to the right side in the figure), the ball member 47 presses the first inclined surface 45*g*1 (a left inclined surface in the figure) of the projection 45*g*, so as to bias the guide plate 45 toward the first position.

Figure 7:
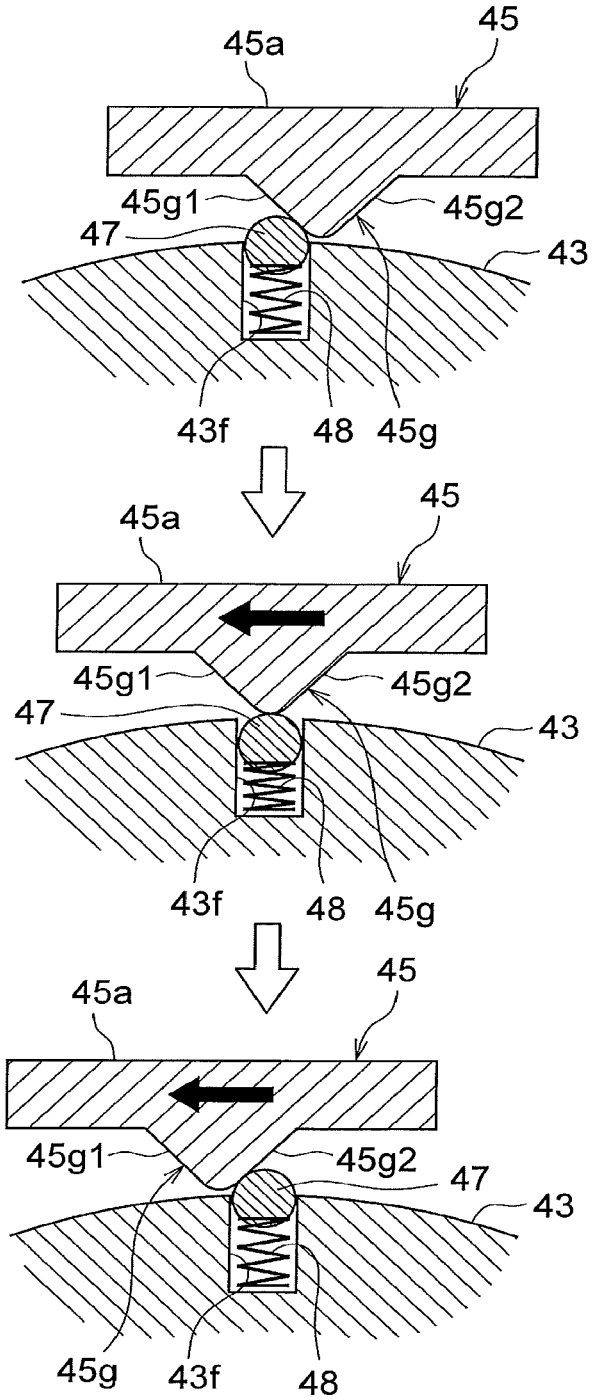
FIG. 7 is an explanatory view of a mechanism to bias the guide plate, according to the embodiment.

Conversely, when the guide plate 45 is biased closer to the second position (closer to the left side in FIG. 7), the ball member 47 presses the second inclined surface 45*g*2 (a right inclined surface in the figure) of the projection 45*g*, so as to bias the guide plate 45 toward the second position, as illustrated on a lower side in FIG. 7. When the guide plate 45 receives a pressing force to be applied from the ball member 47 to the first inclined surface 45*g*1 of the projection 45*g*, the guide plate 45 is biased toward the first position. Further, when the guide plate 45 receives a pressing force to be applied from the ball member 47 to the second inclined surface 45*g*2 of the projection 45*g*, the guide plate 45 is biased toward the second position.

An operation of the cam switch mechanism is described below with reference to FIGS. 5 to 7. First, during an operation of the engine 1, when the low lift cam 41 is selected as described above with reference to FIG. 2, a lift amount and a working angle of the intake valve 10 driven via the rocker arm 15 are relatively small. At this time, as illustrated in FIG. 5, the guide plate 45 in the cam unit 4 is placed at the first position, and its tip side is inclined to the first side (hereinafter, referred to as the left side) in the axis-X direction.

Figure 6A:
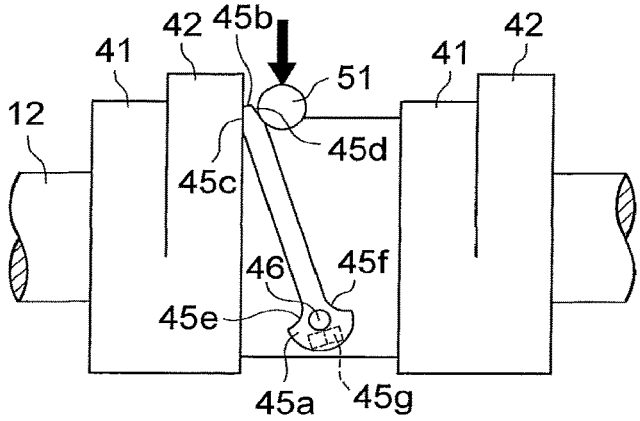
FIG. 6A is a view to describe sliding of the cam unit by engagement between a shift pin and the guide plate.

When the actuator 5 is turned on to switch to the high lift cam 42 in this state, the shift pin 51 moves forward so as to be engaged with a side face of the guide plate 45 on the second side (hereinafter referred to as the right side) in the axis-X direction as illustrated in FIG. 6A. More specifically, the tip end of the shift pin 51 first abuts with the introduction zone 43*a* on the outer periphery of the sleeve 43 of the cam unit 4, and gradually moves forward along with a rotation of the cam unit 4, so that the shift pin 51 engages with the guide plate 45 smoothly.

Figure 6B:
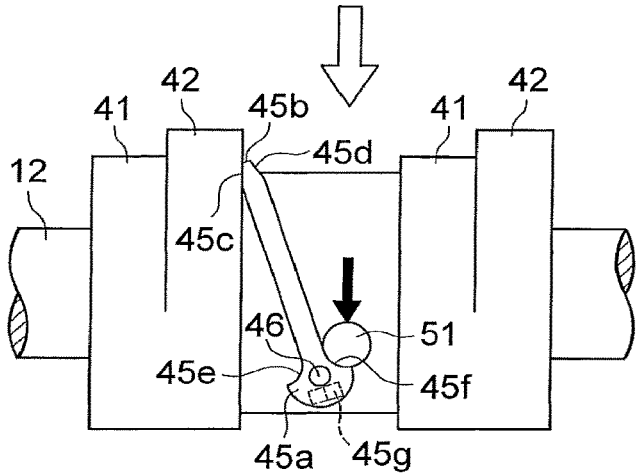
FIG. 6B is a view to describe sliding of the cam unit by engagement between the shift pin and the guide plate, according to the embodiment.
Figure 6C:
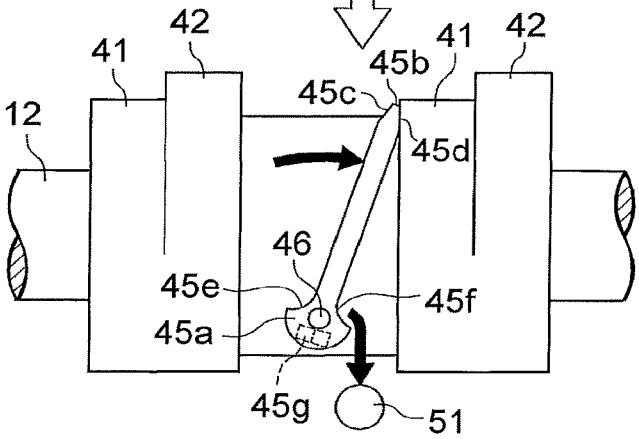
FIG. 6C is a view to describe sliding of the cam unit by engagement between the shift pin and the guide plate, according to the embodiment.

When the cam unit 4 further rotates, the shift pin 51 slides on the right side face of the guide plate 45 as illustrated in FIGS. 6B to 6C, and hereby, the shift pin 51 presses the cam unit 4 leftward in a sliding manner via the guide plate 45. At this time, in the locking mechanism 6 of the cam unit 4, the locking member 61 engaged with the annular groove 43*c* on the inner peripheral surface of the cam unit 4 (the sleeve 43) moves across the annular projection 43*e* as illustrated in FIG. 4A, and then moves to the adjacent annular groove 43*d*, as illustrated in FIG. 4B.

When the cam unit 4 slides to the high lift position as such, the rocker arm 15 is pushed down by the high lift cam 42 against which the roller 15*a* is pressed. As a result, the intake valve 10 operates at a large lift amount and a large working angle. Note that, while the cam unit 4 slides from the low lift position to the high lift position, the roller 15*a* of the rocker arm 15 is pressed against the base circle zones of the low lift cam 41 and the high lift cam 42.

Further, while the cam unit 4 slides from the low lift position to the high lift position, the shift pin 51 slides along the right side face of the guide plate 45. After that, as illustrated in FIG. 6B, the shift pin 51 engages with the right arm 45*f* of the base end 45*a* of the guide plate 45 so as to press the right arm 45*f*. Hereby, the guide plate 45 swings around the spindle 46 of the base end 45*a* so as to be switched to the second position as illustrated in FIG. 6C.

Further, when the guide plate 45 is switched from the first position to the second position, the projection 45*g* provided in the base end 45*a* of the guide plate 45 moves across the ball member 47, as illustrated in FIG. 7. That is, when the guide plate 45 is placed at the first position, the ball member 47 presses the first inclined surface 45*g*1 of the projection 45*g* as illustrated on the upper side in FIG. 7, so as to bias the guide plate 45 toward the first position.

When the guide plate 45 swings as described above, the projection 45*g* pushes down the ball member 47 against a pressing force of the coil spring 48 as illustrated in a middle part of FIG. 7, and moves across the ball member 47. After that, when the guide plate 45 is switched to the second position, the ball member 47 presses the second inclined surface 45*g*2 of the projection 45*g* as illustrated on the lower side in FIG. 7, so that the guide plate 45 is biased toward the second position.

After the guide plate 45 is switched to the second position as described above, the shift pin 51 is separated from the arm 45*f* of the guide plate 45 as illustrated in FIG. 6C and then separated from the base end 45*a* of the guide plate 45 along with the rotation of the cam unit 4. When the actuator 5 is turned off at this time, the shift pin 51 is gradually pushed back in the lead-out zone 43*b* on the outer peripheral surface of the cam unit 4 and moved backward to a position where the shift pin 51 does not engage with the guide plate 45. Then, after that, until the actuator 5 is turned on again to move the shift pin 51 forward, the shift pin 51 does not interfere with the guide plate 45.

Although detailed explanations are omitted, reversely to a case where the low lift cam 41 is selected as described above, when the actuator 5 is turned on in a state where the high lift cam 42 is selected, the shift pin 51 moving forward engages with the first side face, in the axis-X direction, of the guide plate 45 placed at the second position and slides to the base end 45*a*. Hereby, the cam unit 4 is slid from the high lift position to the low lift position on the second side in the axis-X direction. Thus, the low lift cam 41 is selected again, so that the intake valve 10 operates at a small lift amount and a small working angle.

According to the variable valve mechanism of the present embodiment as described above, the cam unit 4 including the low lift cam 41 and the high lift cam 42 is provided around the intake cam shaft 12, and the shift pin 51 is engaged with the guide plate 45 provided on the outer periphery of the cam unit 4, so as to slide the cam unit 4 toward the first side or the second side in the axis-X direction. Hereby, either one of the low lift cam 41 and the high lift cam 42 can be selected to change a lift characteristic of the intake valve 10 between a low lift state and a high lift state.

The guide plate 45 with which the shift pin 51 is engaged swings around its base end 45*a*, so that the guide plate 45 is switched to be inclined toward either one of the first side and the second side in the axis-X direction. Therefore, when the shift pin 51 is engaged with the guide plate 45 so as to slide the cam unit 4 in a reciprocating manner toward the first side and the second side in the axis-X direction, the shift pin 51 relatively reciprocates toward the second side and the first side in the axis-X direction on the outer periphery of the cam unit 4.

Figure 8:
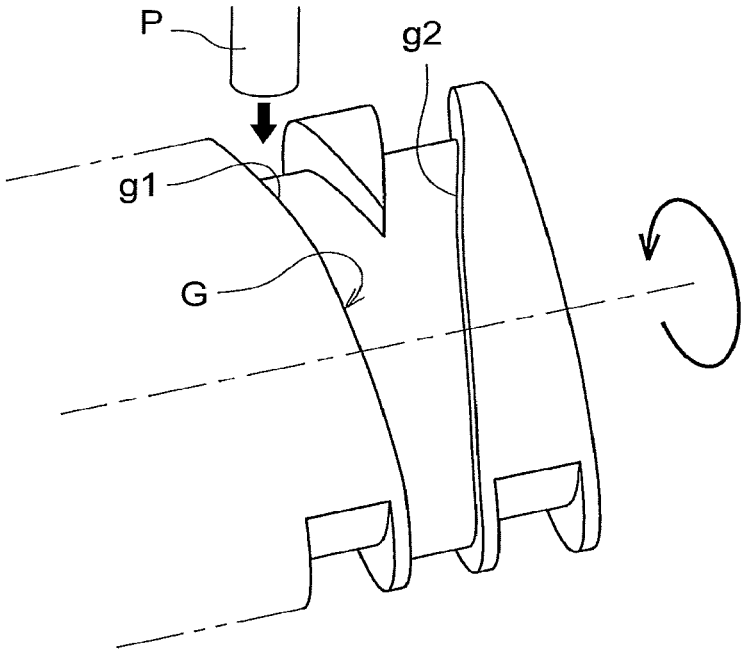
FIG. 8 RELATED ART
FIG. 8 is a perspective view illustrating a Y-shaped guide groove provided in a cam carrier in the related art.

From this point, when a slide amount of the cam unit 4 is indicated by S and a diameter of the shift pin is indicated by D as illustrated in FIG. 5, a width where the guide plate 45 swings on the outer periphery of the cam unit 4 (a distance between the high lift cam 42 on the first side and the low lift cam 41 on the second side) is generally S+D, which is smaller than a width (2×S+D) of a Y-shaped guide groove G (see FIG. 8). This achieves the compactification of the cam unit 4.

Figure 9:
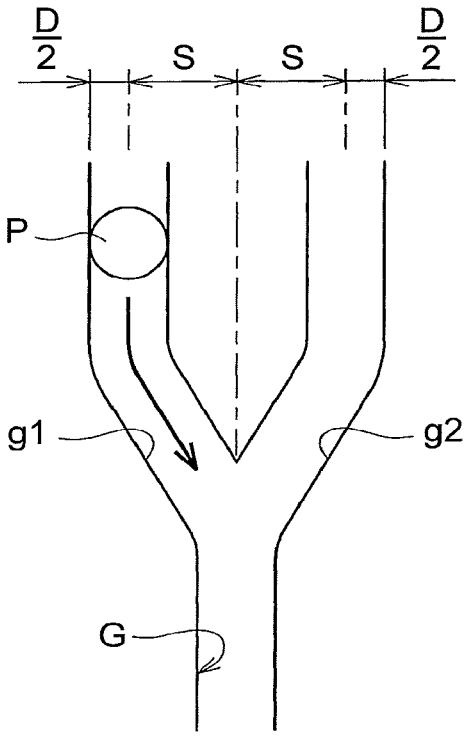
FIG. 9 RELATED ART
FIG. 9 is a developed view illustrating a width necessary for the guide groove in the related art.

Besides, a direction where the guide plate 45 is inclined is different between a time when the cam unit 4 is moved toward the first side in the axis-X direction and a time when the cam unit 4 is moved toward the second side, which is a reverse side to the above. Accordingly, only one shift pin 51 to be engaged with the guide plate 45 is required. In this regard, it is possible to achieve reduction in cost as compared with a case (the related art described above with reference to FIGS. 8 and 9) that requires two shift pins, and even if the guide plate 45 is provided, this does not lead to an increase in cost.

Further, in the present embodiment, the abutting surfaces 45*c*, 45*d* are formed on both sides of the tip end 45*b* of the guide plate 45, and when either of them is brought into surface contact with the side face of a corresponding one of the low lift cam 41 and the high lift cam 42, the guide plate 45 is stably held at a corresponding one of the first position and the second position. At this time, the projection 45*g* of the base end 45*a* of the guide plate 45 is pressed by the ball member 47, so that the guide plate 45 is biased toward the corresponding one of the first position and the second position.

Since the guide plate 45 can be stably held at the first position or the second position as such, it is possible to restrain the guide plate 45 from bounding or vibrating due to a shock at the time when the shift pin 51 engages with the guide plate 45. Further, it is also possible to restrain an excessive force from being applied to the guide plate 45 and the shift pin 51.

Further, at the first and second positions, the guide plate 45 is inclined at a predetermined angle θ, e.g., 25 to 45° in a direction (the up-down direction in FIG. 5) perpendicular to the axis-X on the outer peripheral surface of the cam unit 4. That is, since the inclination angle θ is not large, a frictional force caused when the shift pin 51 engaged with the side face of the guide plate 45 slides along the side face of the guide plate 45 along with a rotation of the cam unit 4 is also small.

Other Embodiments

The present disclosure is not limited to the configuration described in the above embodiment. The above embodiment is just an example, and the configuration, the purpose, and the like of the present disclosure is not limited. For example, in the above embodiment, the guide plate 45 is provided around a center, in the axis-X direction, on the outer periphery of the sleeve 43 of the cam unit 4. However, the present disclosure is not limited to this, and the guide plate 45 may be disposed on a side closer to an end on the first side or the second side. Further, the guide plate 45 may be pivotally supported by a member other than the base end 45*a*.

Further, in the above embodiment, the guide plate 45 is disposed on the outer periphery of the sleeve 43. However, the present disclosure is not limited to this, and the guide plate 45 may be disposed on an outer periphery of a cylindrical member different from the sleeve 43, and the cylindrical member may be connected to an end of the sleeve 43 on the first side or the second side. In this case, the cam unit 4 is constituted including the cylindrical member in addition to the low lift cam 41, the high lift cam 42, and the sleeve 43.

Further, in the above embodiment, the abutting surfaces 45*c*, 45*d* on both sides of the tip end 45*b* of the guide plate 45 are each brought into contact with a corresponding one of the high lift cam 42 and the low lift cam 41, so as to hold the guide plate 45 at a corresponding one of the first and second positions, but the present disclosure is not limited to this. For example, instead of using the cams 41, 42 as the first and second stoppers, projecting portions may be provided on the outer peripheral surface of the sleeve 43 as the first and second stoppers.

Furthermore, the above embodiment deals with the cam switch mechanism that changes the lift characteristic of the intake valve 10 in a DOHC-type valve system of the engine 1. However, the present disclosure is not limited to this, and the present disclosure can be also applied to a cam switch mechanism for changing a lift characteristic of the exhaust valve 11. Further, the valve system is not limited to the DOHC-type valve system, and the present disclosure can be also applied to a SOHC-type valve system.

In the present disclosure, a cam unit can be configured compactly in a cam-switch-type variable valve mechanism. Accordingly, the present disclosure is highly effective when it is applied to an engine to be provided in an automobile, for example.

What is claimed is:

1. A variable valve mechanism, comprising:

a cam shaft;

a cam unit having a cylindrical shape is provided around the cam shaft, the cam unit including a plurality of cams, the cam unit being configured to be slid in a cam axial direction along with a rotation of the cam shaft such that one of the plurality of cams is selected, the cam axial direction being an axial direction of the cam shaft;

a guide portion provided on an outer periphery of the cam unit, the guide portion including a guide plate, a first stopper and a second stopper; and a shift pin configured to be externally engaged with the guide portion, wherein the guide plate is provided on the outer periphery of the cam unit such that the guide plate extends in a circumferential direction of the cam unit, wherein the guide plate is pivotally supported at a part on a base side of the guide plate, while a part on a tip side of the guide plate extending from the part on the base side in a rotation direction of the cam shaft swings so as to incline to one of one side and an other side in the cam axial direction, wherein the first stopper abuts with the part on the tip side from the one side in the cam axial direction to hold the guide plate at a first position inclined toward the one side at a predetermined angle, wherein the second stopper abuts with the part on the tip side from the other side in the cam axial direction to hold the guide plate at a second position inclined toward the other side at a predetermined angle, and wherein arm portions are provided on the part on the base side of the guide plate, the arm portions projecting toward the one side and the other side in the cam axial direction, respectively, to swing the guide plate by engagement with the shift pin.

2. The variable valve mechanism according to claim 1, wherein the first stopper is configured to hold the guide plate placed at the first position in a state where the guide plate is inclined at an acute angle toward the one side, and the second stopper is configured to hold the guide plate placed at the second position in a state where the guide plate is inclined at an acute angle toward the other side.

3. The variable valve mechanism according to claim 1, wherein abutting surfaces are respectively provided on side faces on the one side and the other side at the part on the tip side of the guide plate, and wherein the abutting surfaces make surface contact with the first and second stoppers, respectively.

4. The variable valve mechanism according to claim 1, further comprising:

a ball member that abuts with a projection provided on the guide plate; and a biasing member that presses the ball member toward the projection, wherein the projection includes:

a first inclined surface that is pressed by the ball member so as to bias the guide plate toward the first position, when the guide plate is biased closer to the first position relative to an intermediate position between the first position and the second position, and a second inclined surface that is pressed by the ball member so as to bias the guide plate toward the second position, when the guide plate is biased closer to the second position relative to the intermediate position.

* * * * *